United States Patent [19]

Danley et al.

[11] Patent Number: 4,564,727

[45] Date of Patent: Jan. 14, 1986

[54] SUBWOOFER SPEAKER SYSTEM

[75] Inventors: Thomas J. Danley, Highland Park; Charles A. Rey, Naperville, both of Ill.

[73] Assignee: Intersonics Incorporated, Northbrook, Ill.

[21] Appl. No.: 570,237

[22] Filed: Jan. 12, 1984

Related U.S. Application Data

[63] Continuation-in-part of Ser. No. 325,578, Nov. 30, 1981.

[51] Int. Cl.[4] ..... H04R 13/02

[52] U.S. Cl. ..... 179/116; 381/87; 381/117

[58] Field of Search .... 179/116, 115.5 PS, 115.5 DV, 179/115.5 R; 310/80

[56] References Cited

U.S. PATENT DOCUMENTS

| | | | |
|---|---|---|---|
| 2,926,221 | 2/1960 | Kagdis | 174/115.5 DV |
| 3,855,487 | 12/1974 | Boisseau | 310/80 |
| 3,937,887 | 2/1976 | Miller | 179/1 F |
| 4,295,006 | 10/1981 | Tanaka | 179/1 E |

FOREIGN PATENT DOCUMENTS

| | | | |
|---|---|---|---|
| 126717 | 2/1932 | Austria | 179/116 |
| 45-11386 | 4/1970 | Japan | 179/116 |
| 212857 | 3/1924 | United Kingdom | 179/116 |
| 270421 | 9/1926 | United Kingdom | 179/115.5 |
| 271021 | 5/1927 | United Kingdom | 179/116 |

OTHER PUBLICATIONS

J. S. Swartz, "Commutated Voice Coil," IBM Tech. Disc. Bull., vol. 21, No. 11, Apr. 1979, pp. 4636–4637.

*Primary Examiner*—Gene Z. Rubinson
*Assistant Examiner*—L. C. Schroeder
*Attorney, Agent, or Firm*—Gary, Juettner & Pyle

[57] ABSTRACT

A method and apparatus for producing low frequency sound (20 to 100 Hz) at levels of intensity above the minimum threshold of human hearing. A mechanical-electrical drive having high power capacity is coupled via a linkage to a sound radiator and is responsive to the electrical input from a sound program source. The drive is capable of large excursions at high forces which are substantially constant irrespective of the extent of excursion.

8 Claims, 7 Drawing Figures

SUBWOOFER SPEAKER SYSTEM

CROSS REFERENCE

This application is a continuation-in-part of application Ser. No. 325,578, filed Nov. 30, 1981.

BACKGROUND OF THE INVENTION

This invention relates to loudspeakers and more particularly to sound reproducing devices capable of operating at below 100 Hz and commonly referred to as subwoofers, which attempt to reproduce sounds in the lowermost range of human hearing.

With few exceptions, all loudspeakers available today utilize a cone diaphragm driven by a movable voice coil, which is suspended between the pole pieces of a permanent magnet. Electrical energy conveyed to the voice coil causes the coil to reciprocate in a linear path and move the diaphragm. This type of speaker is commonly known as the permanent magnet dynamic type and generally has an efficiency of less than 5 percent and even less at low frequencies.

A long standing objective in high fidelity sound systems is to provide a speaker that will accurately reproduce low frequency sounds down to the lowermost limits of human hearing. Several problems have prevented the attainment of this objective. It has not been possible to produce sounds down to 20 Hz at sufficiently intense sound levels using conventional speaker design. Also, attempts to reproduce low frequency sounds typically result in excessive distortion, due to the non-linearity of the drive at low frequencies.

The maximum sound pressure level available at low frequencies is dependent upon the acoustic source strength, which is specified by the available area of the vibrating surface and the peak amplitude of vibration. Thus, available acoustic power is dependent upon the volume of air that is "pumped" by the diaphragm. To maintain a constant sound pressure level, each halving of the frequency requires a quadrupling of the peak to peak excursion.

In attempt to achieve accurate low frequency reproduction, conventional speakers have been provided with long voice coils and large magnets, diaphragms and enclosures, etc. There are, however, several limits in the design of such a speaker. First, there is a practical limit on magnet size, design and weight. Also, activation of the longer voice coil results in large power losses in the form of heat ($I^2R$ losses). Possible thermal destruction of the coil imposes a limit on the power handling capacity of the speaker. Moreover, at low frequencies, a point is soon reached at which the driver ceases to operate in a linear fashion because the voice coil is driven out of the region of constant magnetic flux. All of such drives have a limited degree of excursion, which limits the available displacement of the diaphragm.

Another consideration is the relative insensitivity of the human ear to low frequencies, which in turn, requires such low frequencies to be produced at more intense levels to be heard. As illustrated in the Fletcher-Munson hearing sensitivity curves, the threshold of hearing is zero dB at 1000 Hz, but is 40 dB at 100 Hz and about 100 dB at 20 Hz. Since a change of 40 dB involves a corresponding power multiplication of 10,000, attainment of non-distorted sound frequencies in the region of 20 to 60 Hz and at high sound levels has not been practical using conventional apparatus and techniques. No other satisfactory solutions to the foregoing problems have been forthcoming, and low frequency response has been sacrificed with the use of small enclosures and the desire to produce a reasonable spectrum of wavelengths at an affordable price.

In the early stages of speaker development, several proposals were made to utilize a galvanometer-type drive having a rotary output to drive one or several sound radiating panels. Such devices are described in British Pat. Nos. 271,021, 270,421, 212,857, Austrian Pat. No. 126,717, and Japanese Pat. No. 11,384. The drives of all these devices, however, are all in the form of a single coil immersed between two poles of a permanent magnet, which seriously limits available excursion. Also, the available force decreases as the coil departs the field. There are also limits on magnitude of available peak force and power handling capacity, since the drives in these devices have the same or similar limitations as are found in conventional, permanent magnet speakers.

Until recently, there was very little need to reproduce intense levels of sound in the range of 20 to 60 Hz because available programming sources were incapable of recording such frequencies. With the advent of more dynamic recording techniques, however, the ability to produce such sounds without distortion has become a highly desirable objective in the industry.

SUMMARY OF THE INVENTION

The present invention provides a method and apparatus for producing sounds in the frequency range of 100 Hz and down to and below 25 Hz at high intensities and at low distortion levels in a compact cabinet or enclosure. We have discovered that low frequency sound can be produced through the use of a separate driver having a degree of available reciprocal movement that is unlimited or substantially in excess of the largest radiator excursion required at ultra low frequencies, and one that is capable of handling large amounts of current in an efficient manner. In addition, the efficiency of the driver is not dependent on excursion, that is, a substantially constant driving force per unit current is exerted on the sound radiator, irrespective of the extent of movement of the radiator or driver. The ability to maintain a constant force per unit current at large excursions allows for accurate production of high intensity, ultra low frequency sounds, which is an objective never heretofore attained in the art.

In the preferred embodiment described herein, the driver is in the form of a DC commutated servomotor having a rotary output shaft. In such a motor, the current is transferred or switched in the coil as the coil moves in the magnetic flux and causes a constant force per unit current to be maintained on the shaft. In addition and most importantly, there is no inherent limitation on the power handling capability such as exists in a conventional voice coil drive using a permanent magnet.

The constant drive force described above is energized by an amplified signal corresponding to the sound to be reproduced, which causes the shaft to oscillate. The rotary output of the shaft is converted to linear reciprocating motion via a suitable mechanical linkage that is, in turn, connected to the sound radiator, all of which may be arranged in a very compact and versatile system of high efficiency.

Since the force produced by the motor shaft is much greater, i.e., at least ten times greater than that available from conventional speaker drives, and excursion is virtually unlimited, the volume of the enclosure is less a critical factor, and sound levels in excess of 120 dB can be produced at 25 Hz and below, an accomplishment never heretofore attained by conventional speaker system of comparable size, i.e. less than four cubic feet. More than one radiator may be driven from a single driver, and the driver may be geared to produce either a mechanical advantage or amplified linear motion.

Since the drive is much more efficient than a conventional voice coil, there are no limitations that are normally associated with conventional speakers, such as power handling capacity. In fact, the power handling capability of the subwoofer of the present invention is in excess of ten times as much as that of the best available speakers of today.

The electro-mechanical drive arrangement of the present invention is particularly and uniquely suitable for production of low frequency sound, which requires large masses to be moved over relatively long distances. Such drives offer no particular advantages in production of sound above 125 Hz, i.e., in the range where conventional speakers become efficient and linear due to the shorter required excursions and lower power requirements.

IN THE DRAWINGS

DESCRIPTION OF THE PREFERRED EMBODIMENTS

Figure 1:
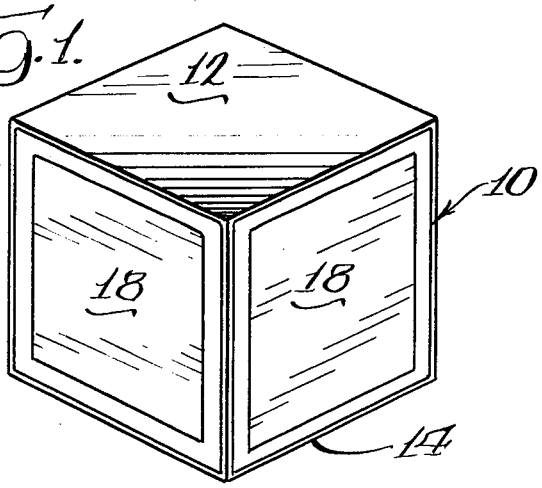
FIG. 1 is a perspective view of a loudspeaker incorporating features of the presently described invention.
Figure 2:
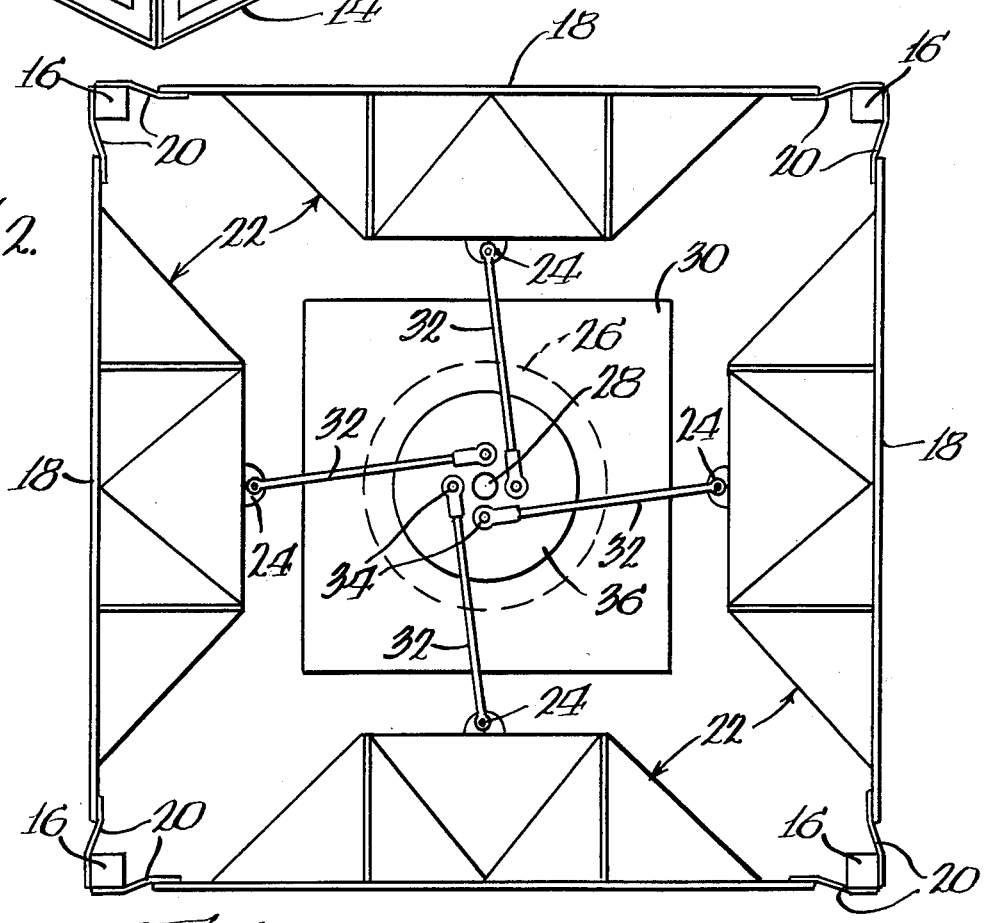
FIG. 2 is a top view of the loudspeaker shown in FIG. 1, with the top removed to reveal the essential internal features.

Referring first to FIGS. 1 and 2, the subwoofer of the present invention may generally comprise an enclosure 10 having solid or non-movable top 12 and bottom 14 panels interconnected by a plurality of upright posts, such as 16. A sound radiating means 18 is resiliently suspended or connected along its upright edges between each pair of adjacent posts 16 to form the enclosure. The connection between the edges of the sound panels 18 and posts 16 may take the form of flexible, shape retaining strips 20, although other suitable connection means may be employed.

Although the present invention will be described in connection with four rectangular or square panels as shown, it will be understood that a system may include only one radiator or panel or any number of a plurality of radiators or horn loading may be employed. Also, while the panels are shown as rigid, flat and square, other shapes such as conical, may be employed, and the radiators may be flexible. The final enclosure is, preferably reasonably air tight, and the radiators and their support structures are preferably of substantially the same size and weight.

Particularly if thin, low mass sound panels 18 are employed, the interior sides thereof may be and are preferably reinforced with a bracing network or framework, shown generally at 22. Such bracing or reinforcing network is preferably coextensive with the interior surface an uniformly supports the panel to prevent bending from the mechanical actuator hereinafter described. A suitable pivot support 24 is secured centrally at the innermost side of each of the frameworks 22.

In summary, one or a plurality of sound radiating means are resiliently mounted around their peripheries and are capable of substantial reciprocating movement along an axis against the surrounding atmosphere. Reciprocation of the radiators for a given distance and rate causes sound to be produced at a given frequency and intensity.

Drive means are provided for reciprocating the sound radiators to produce low frequency sounds, i.e., below 100 Hz, at high intensities, or at intensities that are audible to the human ear in the desired frequency range. The drive means is also capable of producing a drive or output force that is substantially constant at a given excitation level, i.e., per unit of current used to activate the drive means.

In the preferred embodiment, the drive means preferably is a high speed DC commutated servomotor. Such motor has a coil immersed in a magnetic field. In addition, the motor includes commutation means, i.e., means to transfer or switch the current in the active portions of the coil as the coil is rotated, such that the active portion of the coil is always immersed, and driven by, the region of constant magnetic flux. The shaft of the motor, which is capable of unlimited rotation, therefore produces a force that is substantially constant per unit of current carried by the coil, regardless of the extent or degree of rotation of the shaft. One type of suitable motor is sold under the name Electro-Craft as Model No. M-1450/M-1460.

It will be appreciated that in conventional speaker drives, the extent of the region of constant magnetic flux is limited, and linear excursions in excess of 0.5 inch are difficult to attain. In the drive of the present invention, DC resistance and $I^2R$ losses are reduced and the coil inductance is lowered, and very large or unlimited excursions without positional dependance are easily achieved. Whereas a voice coil drive has a typical maximum efficiency of about 10%, the drive of the present invention has an efficiency in excess of 75% and typically 85%. Moreover, for a given frequency range and acoustic output, the subwoofer of the present invention will require approximately one-eighth of the volume required by a conventional speaker system.

It will be apparent that other types of drives, both linear or rotary, may be employed, provided that they meet the foregoing criteria, namely: (i) efficient high power handling capability; (ii) with an unlimited amount of excursion, or an amount equal to or in excess of that required to produce low frequency sound at required intensities; and (iii) having an output that is substantially constant per unit of excitation, irrespective of the degree of excursion. Other suitable drives, for example, might be based on switchable linear electrical drives, or pneumatic or hydraulic drives.

In the preferred embodiment, the electric motor 26 having an upright shaft 28 is mounted centrally within the enclosure 10 on a support 30 rigidly affixed to the base 14 or other suitable support. The motor shaft 28 is positioned so as to be substantially equi-distant from the vertical centerline of each of the sound radiators.

Means are provided for translating the rotary output of the motor shaft 28 into suitable motion for driving one or more of the radiators 18, or the rigid framework 22 associated therewith. Such means, for example, may include rods 32 pivotally connected at one end to each of the supports and pivotally connected by vertical pin pivots 34 to a disc 36 secured to and mounted for rotation with the motor shaft 28. The pivot points of pivots 34 are preferably equi-spaced from the axis of shaft 28 such that substantially an equal driving force will be imparted to each of the rods 32 and their associated frameworks 22 and sound panels 18. Also, in the embodiments shown, the pivots 34 of opposite panels fall on a common centerline through the panels, such that the entire arrangement is highly symmetrical and balanced.

As current is applied to the motor 26, the shaft 28 and disc 36 rotate, displacing the pivots 34 toward their respective panels and causing each of the panels 18 to be displaced outward. To achieve this effect, it will be apparent that the pivots at zero power are located on the disc 36 to one side of the center line through its associated panel in order to provide necessary leverage for movement. The mechanical arrangement is in effect a series of compound levers or toggles, which are capable of directly imparting linear motion to the panels.

Figure 3:
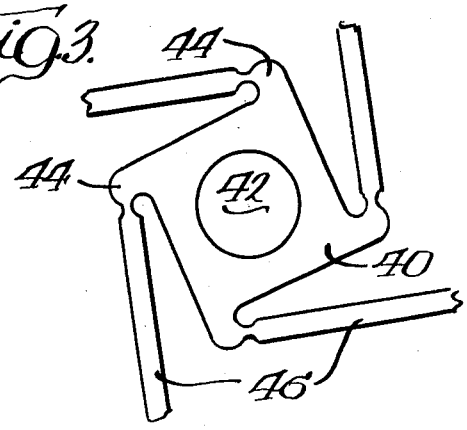
FIG. 3 is a plan fragmentary view of an alternate form of mechanical linkage useful in connection with the presently described invention.

Another form of mechanical linkage that may be used is shown in FIG. 3. This embodiment is similar in operation to that shown in FIG. 2, and comprises a disc-like member 40 mounted on a shaft 42 and having a plurality of ears 44 equally spaced around the perimeter of the disc. The ears 44 are connected to rods 46 by means of a relatively thin web 48, rather than the mechanical joint shown in FIG. 2. Thus, the FIG. 3 embodiment may be a one piece construction made from a tough, flexible polymer, which would minimize development of sloppiness in the mechanical system.

Figure 5:
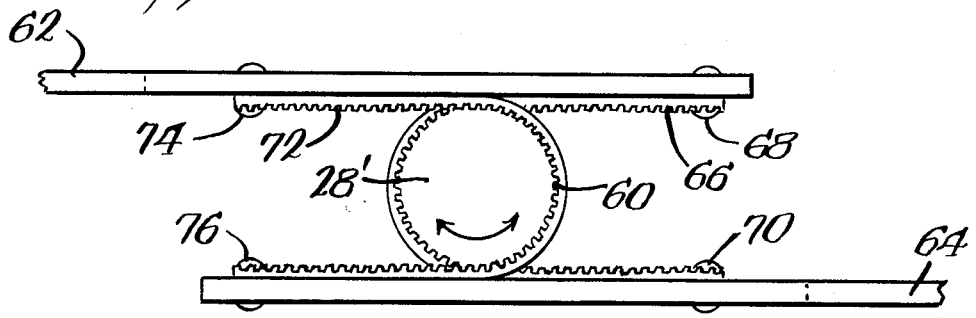
FIG. 5 is a top view showing another form of linkage useful in the loudspeaker of FIG. 2.
Figure 6:
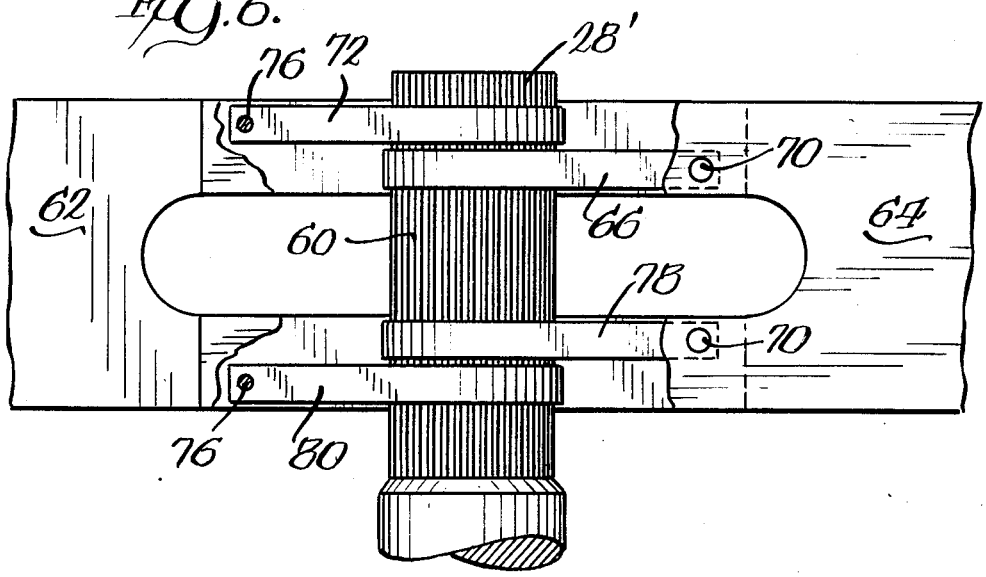
FIG. 6 is a side view of the linkage of FIG. 5.
Figure 7:
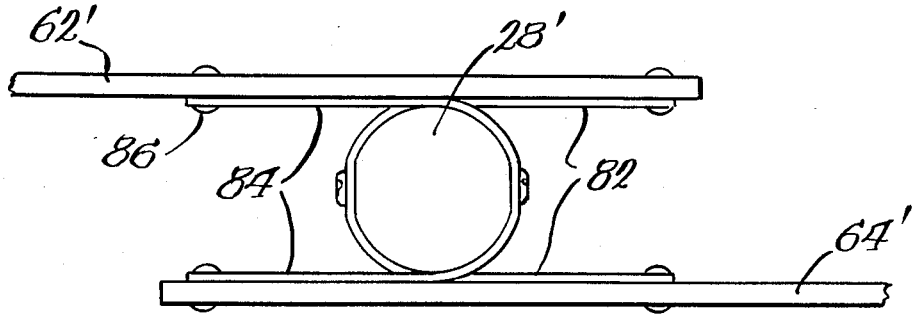
FIG. 7 is a top view of another embodiment of a linkage similar to FIG. 5.

It will be appreciated that many other means may be used to translate the rotary motion of motor 26 into a motion suitable to drive the radiators 18, as, for example, illustrated in FIGS. 5, 6 and 7.

As shown in FIGS. 5 and 6, the shaft 28' may be provided with a geared or toothed surface at 60 as shown. The rods 32 shown in the previous embodiment are replaced by rigid elongated beams 62 and 64 which may have bifurcated ends that overlap on opposite sides of the shaft 28' as shown. The beams 62 and 64 are wide in a direction parallel to the shaft for added stiffness in a direction perpendicular to their length.

As shown in FIGS. 5 and 6, a flexible toothed belt 66 is secured at one end at 68 near the end of one beam 62, wrapped around one side of the shaft 28' and secured at the other end at 70 near the end of the other beam 64. A second belt 72 is disposed around the other side of the shaft above the first belt and has its respective ends secured at locations 74 and 76 inwardly of the ends of the respective beams 62 and 64. The teeth of the belts engage the teeth of the shaft 28' to prevent any slippage therebetween. The belts in effect define opposing loops around the shaft, and the belts are tightly secured relative to each other to eliminate any free play. As shown in FIG. 6, a second set of belts 78 and 80 may be employed around the shaft for added integrity in the arrangement.

A similar mechanical arrangement is shown in FIG. 7 wherein a pair of bendable but otherwise substantially rigid strips 82 and 84 are disposed around opposite sides of the shaft 28' and secured as aforesaid to the respective beams 62' and 64'. The strips 82 and 84 may be composed of a suitable material such as spring steel. In this embodiment, positive engagement between the shaft 28' is achieved by means of features 85 or other attachment means extending between the strips and the shaft. Preferably, the fasteners 85 are located approximately in the center of each strip to allow maximum rotation of the shaft in either direction.

In operation, it may be seen that the belts 66 and 72 and the strips 82 and 84 are operatively connected to the shaft, and upon rotation of the shaft, serve to push or pull both beams simultaneously in opposite directions.

The embodiments of FIGS. 5–7 have several advantages in that there is little or no opportunity for slack to develop in the linkage that might adversely affect performance of the speaker. Also, it may be seen that the beams reciprocate in a direction substantially perpendicular to the plane of the speaker panels rather than at a slight angle required in the previously described embodiment. This in turn allows the speaker panels to reciprocate more exactly in parallel and eliminates the tendency for any movement away from an axis normal to opposed panels.

It may also be seen in connection with the embodiments of FIGS. 5 through 7 that rotary motion of the shaft can be easily geared up or down to produce a mechanical advantage or to provide additional excursion per unit of the shaft, depending on the specific requirement of the system.

The present invention provides several advantages that have never before been available for sound production because of theoretical and practical limitations. The primary advantage is the ability to produce high intensity, undistorted musical or other sounds from a loudspeaker within the frequency range of 20 to 100 Hz, which is enabled because of the linear, high power motion available to the radiators and the ability to move the radiators through large excursions. Unlike sound reproduction at middle or upper frequencies, a subwoofer is more akin to an air pump, and performance is directly dependent upon the volume of air that can be moved, i.e., excursion limits and area of the radiator. Thus, the system of the present invention is very uniquely and specifically adapted to production of high intensity, low frequency sound.

Another problem that is overcome by the present invention is the ability to produce undistorted sounds at low frequency. A conventional voice coil speaker can easily produce middle and upper frequencies because the required coil-cone excursion is very small. When the frequency decreases, not only do the power demands become greater, but the required radiator excursion causes the voice coil to move outside of the region of constant flux of the permanent magnet, and the available drive force decreases rapidly, causing gross distortions. Such distortions are eliminated in the present system because the drive force per unit current remains constant, regardless of the amount of excursion.

Figure 4:
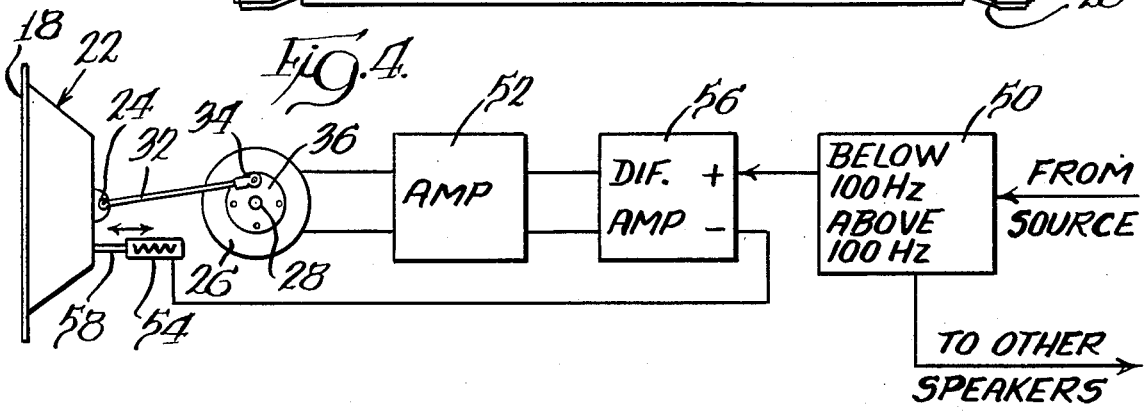
FIG. 4 is a schematic illustrating the mechanical and electrical components useful in practicing the present invention.

The preferred circuitry and components for driving the speaker system are shown in FIG. 4. Inasmuch as only well known conventional components are being employed, they will be described by function for the sake of brevity.

As shown, an audio signal from any source is fed into a cross-over network 50, which is an electrical filter that separates the output signal into two or more separate frequency bands. In the present example, the higher frequencies, e.g., above 100 Hz are separated and routed to other speakers, and the frequencies below 100 Hz are fed into the present system.

The incoming signal is preferably amplified to the desired degree by an amplifier 52, since the incoming signal from conventional sources would usually be insufficient to drive the motor 26 at the desired output.

In addition, a negative feedback system may be provided around the motor 26 and amplifier 52, which serves as a corrective means to improve performance. As shown, a position sensor 54 is responsive to motion of a sound panel, and the output of the sensor is fed back into a differential amplifier 56 connected between the cross-over 50 and the amplifier 52. The sensed voltage is proportional to the degree of oscillatory motion of the sound panel.

As shown, the position sensor 54 is of the variable reluctance type having an arm 58 connected directly to one of the sound panel bracings 22 whereby the relative position of the panel is sensed and fed back to the differential amplifier 56. Other electromechanical sensing devices may be employed, as well as others, including optical and air pressure means.

The differential amplifier 56 is in effect an amplifier having two similar input circuits so connected that they respond to the difference between two voltages or currents but effectively suppress like voltages or currents. The differential amplifier therefore creates an error signal which is converted to an output signal and has a transient response which decays with time. The negative feedback therefore effectively controls the movement of the sound panels 18 and tends to correct such movement to the incoming signal and improves distortion characteristics.

In operation, the incoming signal is amplified and fed into the motor, causing the shaft 28 first to move counterclockwise and then oscillate rapidly in response to the input frequencies. The sound panels, in turn, move in and out together in phase to reproduce the low frequency sound waves.

As an example of the present invention, a subwoofer having the following performance characteristics was prepared in an enclosure of less than 3 cubic feet:

Power Capacity: 300 watts RMS, 3000 watts peak
Response: ±3db 25–100 Hz at 300 watts RMS
Excursion limit: 1.5 inches
BL: 27N/amp
Effective intertia: 2.5 lbs.
Max force at full avg. power: 48 lbs.
Peak force: 180 lbs.

We claim:

1. A subwoofer speaker for producing audible sound at frequencies below 100 Hz, said speaker comprising sound radiating means for producing sound upon reciprocation thereof, drive means for reciprocating said sound radiating means, said drive means comprising an electrical motor having a rotary coil with the active elements thereof continuously immersed in a magnetic field, said coil exhibiting a substantially constant force per unit of excitation current irrespective of the rotary position of the coil, a rotary output shaft connected to the coil, and means for connecting said shaft to said sound radiating means.

2. The subwoofer of claim 1 wherein said means for connecting said shaft to said sound radiating means comprises means for converting rotary to linear motion.

3. The subwoofer of claim 1 wherein said sound radiating means comprises a plurality of separate members.

4. The subwoofer of claim 2 wherein said means for converting rotary to linear motion additionally comprises means to provide a mechanical advantage from rotary to linear motion.

5. A subwoofer speaker system comprising a support, a sound diaphragm associated with said support for reciprocal movement against the air, a source of elecrical signal current corresponding to the sound to be reproduced, drive means mounted on said support for driving said sound diaphragm, said drive means comprising a rotatable coil connected to said source, a magnetic field around the coil having a region of constant magnetic flux, and means associated with said coil for retaining the active elements thereof in said region of constant magnetic flux irrespective of the rotational position thereof, and a rotary shaft connected to the coil and being driven thereby, and means connected between the shaft and the diaphragm for converting rotary motion of the shaft to linear motion at the diaphragm, the excursion of the diaphragm being sufficient to produce sound at audible intensities below 100 Hz.

6. The subwoofer speaker system of claim 5 wherein the force of movement of said coil per unit input current is substantially constant irrespective of the rotary position of said coil.

7. The subwoofer of claim 6 wherein the means between the shaft and diaphragm is a mechanical linkage.

8. The subwoofer of claim 6 wherein the means between the shaft and diaphragm comprises a rack and pinion drive.

* * * * *